US005857526A

United States Patent [19]

Manges

[11] Patent Number: 5,857,526

[45] Date of Patent: Jan. 12, 1999

[54] PORTABLE FIRE FIGHTING APPARATUS

[76] Inventor: Huey G. Manges, 2109 NE. East 24th St., Fort Lauderdale, Fla. 33305

[21] Appl. No.: 775,887

[22] Filed: Jan. 2, 1997

[51] Int. Cl.[6] ..... A62C 5/02

[52] U.S. Cl. ..... 169/52; 169/15

[58] Field of Search ..... 169/52, 62, 14, 169/15, 30

[56] References Cited

U.S. PATENT DOCUMENTS

| | | | |
|---|---|---|---|
| 732,143 | 6/1903 | Van Riper et al. | 169/15 |
| 1,859,326 | 5/1932 | Burmeister | 169/15 |
| 2,832,425 | 4/1958 | Jacobs | 169/15 |
| 4,318,443 | 3/1982 | Cummins | 169/15 |
| 4,420,047 | 12/1983 | Bruensicke | 169/53 |
| 4,805,700 | 2/1989 | Hoover | 169/15 |
| 4,917,193 | 4/1990 | Ockler | 169/24 |
| 5,348,099 | 9/1994 | Yokoi | 169/51 |
| 5,419,497 | 5/1995 | Warrington | 239/722 |
| 5,623,995 | 4/1997 | Smagac | 169/30 |

FOREIGN PATENT DOCUMENTS

| | | | |
|---|---|---|---|
| 247211 | 12/1987 | European Pat. Off. | 169/52 |

*Primary Examiner*—Andrew C. Pike

*Attorney, Agent, or Firm*—Morgan & Finnegan, L.L.P.

[57] ABSTRACT

A portable fire fighting and vapor suppression apparatus includes a cart having sides defining an enclosure and is a size so that it can be manually moved by a single individual. The cart includes a bottom having wheels mounted thereon. The cart has an internal partition forming an enclosed storage area that is separate from the rest of the enclosure which forms a sealed holding tank for storing a foam concentrate. An eductor is mounted within the enclosed storage area and has an inlet for connecting to a source of high pressure water. The foam eductor includes a foam mixing portion and a discharge. A foam pickup tube is connected to the foam mixing portion and extends through the internal partition to the form holding tank for sucking foam concentrate as water is forced through the inlet and eductor. A fire hose having one end connected to the eductor discharge is stored within the enclosed storage area in a double donut configuration so that as the hose is withdrawn, a corresponding length of hose connected to the eductor is withdrawn.

12 Claims, 2 Drawing Sheets

PORTABLE FIRE FIGHTING APPARATUS

FIELD OF THE INVENTION

This invention relates to a portable fire fighting and vapor suppression apparatus that is mobile, compact, and efficient in use.

BACKGROUND OF THE INVENTION

Marine vessels and other vessels such as airplanes have serious fire and hazard areas. Any fires breaking out in these fire and hazard areas must be controlled even when the smallest fire occurs. In these fire and hazard areas, it has been common to include a fire fighting system having a foam concentrate stored in a fixed canister. A hose is connected to the canister and foam is sprayed alone or mixed with water or some other liquid and sprayed at the source of the fire.

It has been found desirable to have a portable fire fighting system, such as on a cart that can be wheeled through different parts of the vessel, and a fire hose which is initially stored in the cart. The cart can be moved to an area adjacent to the source of the fire and the fire hose withdrawn for spraying the combination foam concentrate and water at the fire.

One example of this type of fire fighting apparatus is disclosed in U.S. Pat. No. 4,420,047 to Bruensicke, which includes a pressurized propellant tank stored on a mobile cart, another tank for storing foam, one serpentine supply hose which connects to a source of water, and a second serpentine fire hose having a nozzle. This fire hose is stored in the top portion of the cart and foam and water is discharged through the nozzle. To access the various controls and hoses, a front access door and a top access door must be opened.

It would be advantageous if a compact and mobile fire fighting apparatus could be designed that efficiently stores a fire hose without using moveable access doors, facilitates easy foam withdrawal and mixing with water, and readily attaches to a source of high pressure water such as pump driven sea water. It would also be advantageous if the design could be aesthetic because the apparatus will be visible and typically stored on the vessel deck.

Other examples of foam systems or similar fire suppression systems include U.S. Pat. Nos. 5,419,497 to Warrington; 5,348,099 to Yokoi; 4,917,193 to Ockler; 4,805,700 to Hoover; 4,318,443 to Cummins; 2,832,425 to Jacobs; 1,859,326 to Burmeister; 732,143 to Van Riper et al.; and European Patent No. 0247211.

SUMMARY OF THE INVENTION

The present invention now provides a portable fire fighting and vapor suppression apparatus having a simple design and is aesthetic and portable. The portable fire fighting and vapor suppression apparatus includes a cart having sides defining an enclosure. The cart is a size so that it can be manually moved by a single individual, and includes a bottom section and wheels mounted on the bottom to allow the cart to be wheeled about a location.

The cart has an internal partition forming an enclosed storage area that is separate from the rest of the enclosure. The balance of the enclosure forms a closed holding tank that is sealed for storing a foam concentrate to be later mixed with high pressure water.

A foam eductor is mounted within the enclosed storage area and has an inlet for connecting to a source of high pressure water. The foam eductor includes a foam mixing portion and a discharge. A foam pickup tube is connected to the foam mixing portion of the eductor and extends through the internal partition to the holding tank. As water is forced through the eductor, a vacuum draw is created as is conventionally known, which sucks the foam concentrate through the pickup tube as water is forced through the inlet of the eductor.

A fire hose has two ends. One end is connected to the eductor discharge and a nozzle is connected on the other end of the fire hose through which water and foam is discharged. The fire hose is stored within the enclosed storage area in a double donut configuration so that as the hose is withdrawn, a corresponding length of hose connected to the eductor is withdrawn.

In one aspect of the invention, the cart is substantially rectangular configured and includes a top, bottom, opposing front and rear sides, and two opposing sides to define a substantially rectangular configured enclosure. The internal partition extends medially between two opposing sides along a substantial portion of the height of the cart adjacent the front side to form the enclosed storage area that extends along the front of the cart. The internal partition also extends toward the rear side in the area adjacent the top of the cart to form an enlarged storage well where the coiled fire hose can be stored. The handle is mounted on the top of the cart to facilitate manual rolling, and the enlarged storage well includes an upper concave surface formed in the partition against which the stored roll of fire hose is positioned.

An opening is formed on the top through which foam concentrate can be poured into the holding tank. The foam pickup tube extends vertically downward from the partition to the bottom of the cart. The foam pickup tube includes a discharge end through which foam is discharged and a drain plug is removably mounted on the discharge end of the pickup tube so that the foam concentrate can be withdrawn from the holding tank when desired.

BRIEF DESCRIPTION OF THE DRAWINGS

The invention and its mode of operation will be more clearly understood from the following detailed description when read with the appended drawings in which.

DETAILED DESCRIPTION

Figure 1:
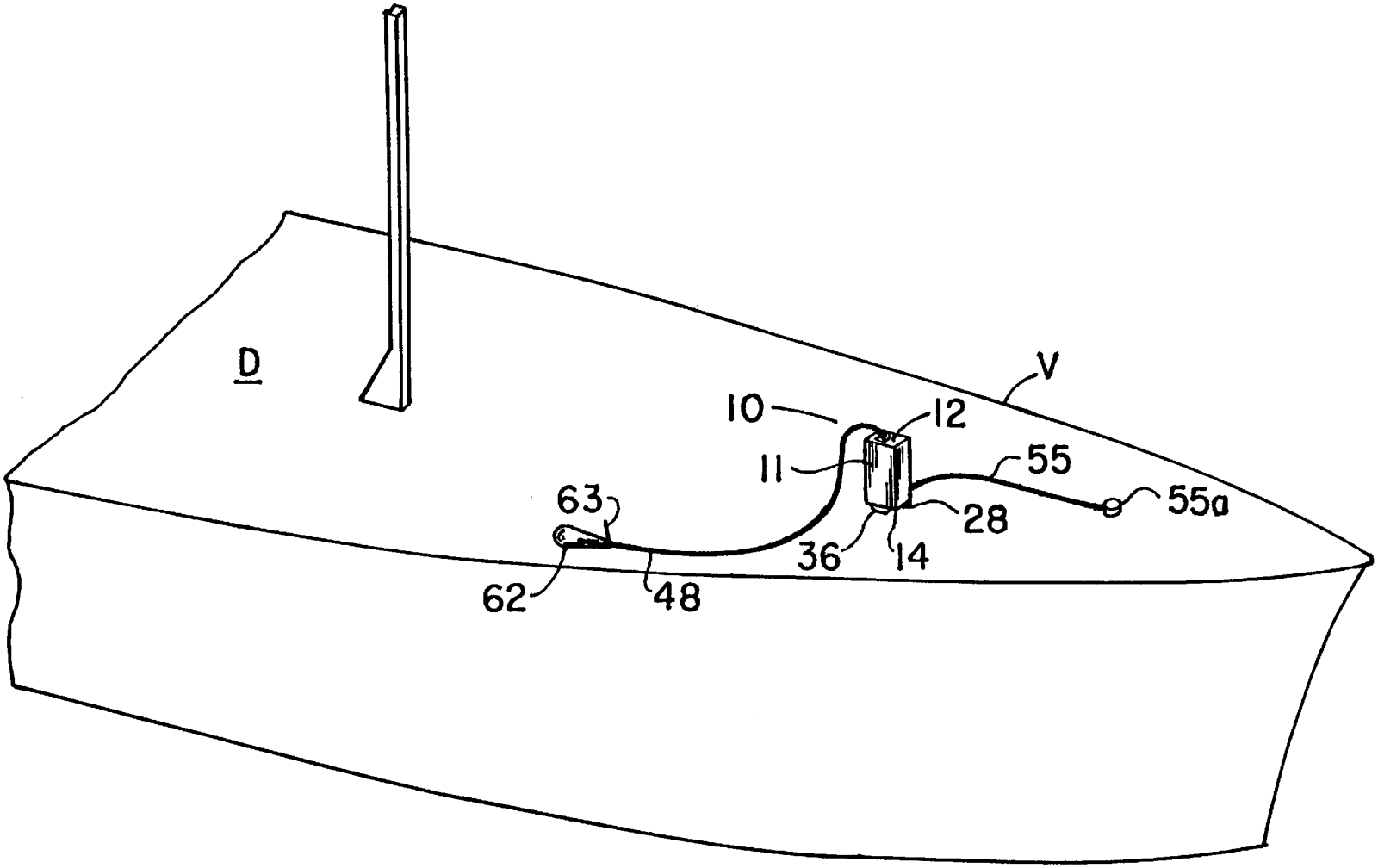
FIG. 1 is a perspective view of the portable fire fighting and vapor suppression apparatus in accordance with the present invention shown on the deck of a marine vessel.

Referring now to FIGS. 1–4 and more particularly to FIG. 1, there is illustrated generally at 10 the portable fire fighting and vapor suppression apparatus of the present invention rolled onto the deck "D" of a marine vessel "V" moored at a dock. The apparatus 10 is shown as formed in a substantially rectangular configured cart, indicated generally at 11, having a top 12, a bottom 14, opposing front and rear sides 16, 18, and two opposing sides 20 to define a substantially rectangular configured enclosure indicated generally at 22 in FIGS. 2 and 3. The cart 11 typically can formed from a rigid plastic, metal such as sheet steel or aluminum, fiberglass, or other similar material, and is a size so that it can be manually moved by a single individual. An example of a representative size for the cart 11 includes a height about 3 feet, and a width about 16 by 18 inches. As will be explained later, these dimensions allow about a 33 gallon concentrate, or 270 pounds of liquid foam fire fighting concentrate to be stored within the cart 11.

Along the front 16 near the bottom 14, an axle 24 is mounted for rotation and held by brackets 26 (FIG. 2) and has wheels 28 mounted on either end of the axle 24. Typically, eight-inch wheels 28 have been found suitable for the contemplated size of the cart. A portion of the front 16 and bottom 14 is cut away to form wheel wells 30, where the upper portion of the wheels 28 are situated.

Typically the cart 11 is painted a bright red like all common fire extinguisher to indicate emergency use. The cart 11 is stored in a highly visible corner or accessible area (not shown) of a vessel so that it is easily accessible to almost anyone on the vessel. A handle 32 is mounted on handle supports 34 at the top 12 to facilitate manual grasping and ready maneuverability of the cart 11. A leg support 36 is mounted on the bottom 14 at the rear 18 and is about three inches in height so that the lower portion of the wheels 28 that engage the ground are level with the bottom of the leg 36.

Figure 2:
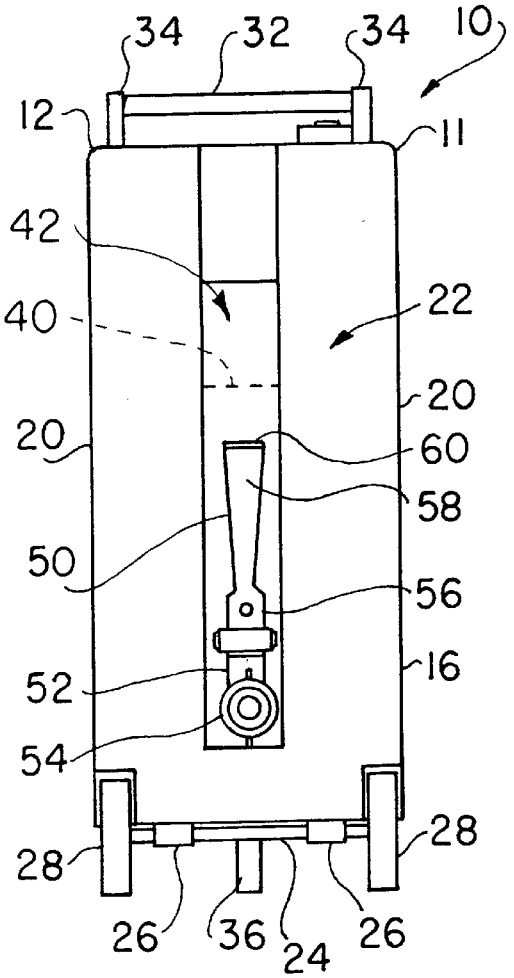
FIG. 2 is a schematic front elevation view of the portable fire fighting and vapor suppression apparatus of the present invention.
Figure 3:
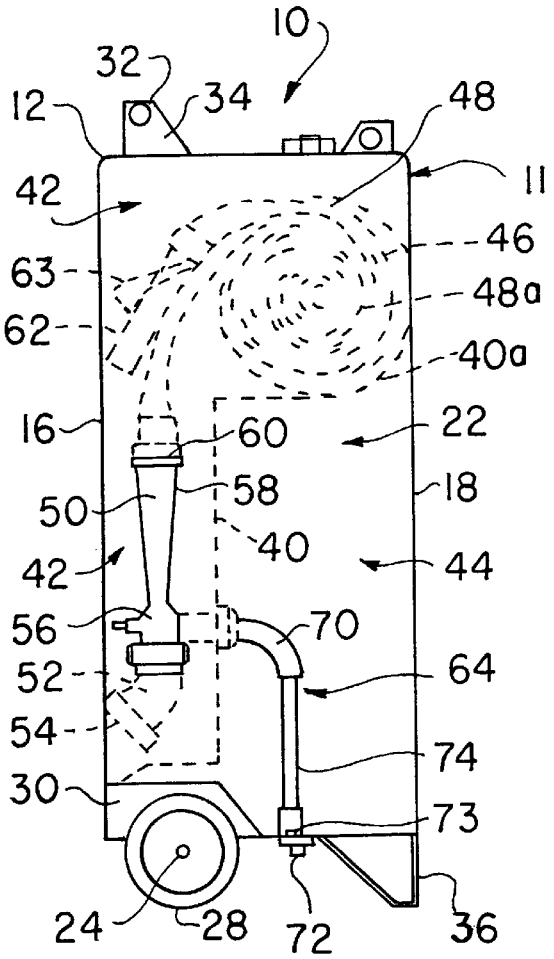
FIG. 3 is a schematic side elevation view of the portable fire fighting and vapor suppression apparatus of the present invention.

As shown in the schematic diagram of FIG. 3, an internal partition wall 40 extends medially between the two opposing sides 20 and along a substantial portion of the height of the cart 11 adjacent to the front side 16. The partition wall 40 forms an enclosed storage area indicated generally at 42, which extends along the front 16 of the cart 11 and remains separate from the rest of the formed enclosure 22. The other part of the enclosure 22 opposite the partition wall 40 forms a holding tank, indicated generally at 44, which stores a fire fighting foam concentrate known to those skilled in the art. As illustrated in FIG. 3, the internal partition 40 extends toward the rear side 18 in a concave wall section 40*a* in the area adjacent to the top 12 of the cart 11, to form an enlarged storage well 46 where a coiled fire hose 48 can be stored. As shown in FIG. 2, the partition wall 40 forms a storage area 42 that has a narrow width between the opposing sides 20.

As illustrated in FIG. 3, a foam eductor 50 is mounted within the storage area 42 and includes a water inlet 52 positioned near the bottom 14 of the cart 11 for connecting to a source of high pressure water, such as can commonly be found on marine vessels. The inlet 52 includes a conventional marine fitting 54 commonly found in marine vessel pipe connections. A high pressure hose 55 (FIG. 1) could be connected to the fitting 54 and could remain fixed thereto in preparation for fire emergencies. The high pressure hose 55 in the illustrated example is shown connected to a water supply fitting 55*a* vessel deck. Sea water is pumped through the vessel.

The eductor 50 includes a foam mixing portion 56 that extends upwardly into a manifold area along the front 16 into a discharge 58 having a conventional marine fitting 60 at its end which is connected to one end of a standard fire hose 48. A nozzle 62 is connected onto the other end of the fire hose 48 through which the combined water and foam concentrate are discharged. The nozzle can be a conventional nozzle with a lever 63 for turning off/on and changing the spray pattern from a broad spray pattern to an essentially narrow, high velocity jet. The fire hose 48 is stored in a double donut roll indicated at 48*a*, so that as the hose is withdrawn, a corresponding length of hose connected to the eductor 50 is withdrawn.

Figure 4:
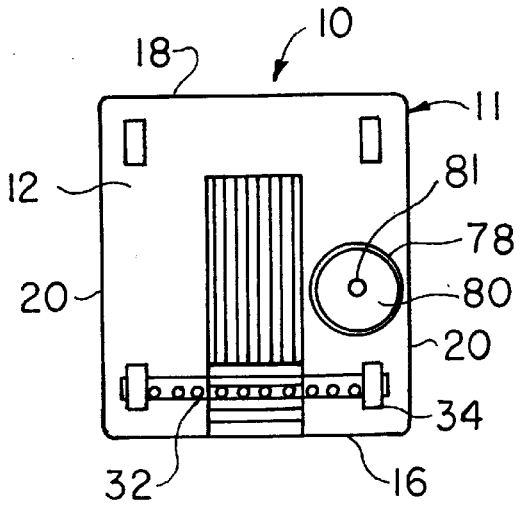
FIG. 4 is a top plan view of the portable fire fighting and vapor suppression apparatus of the present invention.

Referring again to FIG. 3, a foam pickup tube 64 is connected to the foam mixing portion 56 of the eductor 50 and extends through the sealed internal partition 40 and into the holding tank 44. The foam pickup tube 64 extends vertically downward after bending 90 degrees by means of a 90-degree elbow 70. The foam pickup tube extends downward to the bottom 14 where a drain plug 72 connects into an opening 73 located at the end of the pickup tube indicated generally at 64. The removal of the drain plug 72 allows any foam concentrate contained in the holding tank 44 to be discharged through the foam pickup tube and through the opening 73. This is useful when the type of foam concentrate is to be changed or the foam pickup tube 64 includes a perforated portion 74 that permits foam to enter the tube 64 for either discharge through the opening 73 when the drain plug 72 is removed or through the 90-degree elbow 70 and into the eductor 50 for mixing with the high pressure water supplied through the inlet 52 and high velocity discharge through the fire hose nozzle 62. As shown in FIG. 4, a foam fill opening 78 is formed in the top 12 of the cart 11 and has a cap 80 to close the fill opening 78, after fire fighting foam has been poured through the fill opening 78 into the holding tank 44.

In operation, when the fire fighting apparatus 10 of the present invention is needed, such as when a fire breaks out on a marine vessel, the fire fighter, captain, passenger, or one close to the apparatus grasps the handle 32 and tilts the cart 11 slightly forward so that the leg 36 is raised off the vessel deck. The cart 11 is rolled quickly to an area near the fire. Typically, a high pressure water supply hose is already connected to the inlet 52 so that the cart 11 only needs to be rolled to an area near the fire. The fire hose then is dragged from the fire hose opening.

As the fire hose is withdrawn, the nozzle 62 is turned on and opened by pulling back on the lever 63 and adjusting the spray pattern to suit the need of the fire fighter. Because the cap 80 includes a vent 81, atmospheric pressure is still maintained in the enclosure and holding tank 44 so that foam concentrate can be withdrawn through the perforated portion 74 of the pickup tube and into the eductor 50 to mix with the high pressure water drawn through the inlet 52.

It is evident that the portable fire fighting and vapor suppression apparatus of the present invention now allows a compact unit to be stored on a marine vessel or other similar vessel. It can be easily moved and efficiently stores a fire hose that can be readily withdrawn from the cart. No special doors and connections are necessary and the operation of the apparatus is simple.

What has been described is merely illustrative of the present invention. Other applications to various fire fighting apparatus and similar apparatus are contemplated as being within the knowledge of one skilled in the art and may be used without departing from the spirit and scope of the present invention.

I claim:

1. A portable fire fighting and vapor suppression apparatus comprising a cart having sides defining an enclosure, wherein said cart is a size so that it can be manually moved by a single individual, said cart including wheels mounted on the cart to allow the cart to be wheeled about a location, said cart having an internal partition forming an enclosed storage area that is separate from a remainder of the enclosure and forming a formed holding tank for storing a foam concentrate, a foam eductor mounted with the enclosed storage area and having an inlet for connecting to a source of water, said foam eductor including a foam mixing portion and a discharge, a foam pickup tube connected to the foam mixing portion of the eductor and extending through the internal partition to the formed holding tank for drawing the foam concentrate to the eductor as the water is forced through the inlet and the eductor, and a fire hose having two ends, one of the ends connecting the eductor discharge and a nozzle on another of the connecting ends of the fire hose through which the water and the foam concentrate is discharged, wherein said fire hose is stored within the enclosed storage area in a double donut configuration so that as the fire hose is withdrawn, a corresponding length of the fire hose connected to the eductor is withdrawn.

2. The apparatus according to claim 1 further including a handle mounted on said cart to facilitate manual rolling of said cart.

3. The apparatus according to claim 1 wherein said internal partition includes an upper concave surface forming a well against which the stored fire hose is situated.

4. The apparatus according to claim 1 further including a housing wall having a fill opening formed therein through which the foam concentrate is poured into the formed holding tank.

5. The apparatus according to claim 1 wherein said foam pickup tube extends vertically downward after entering the formed holding tank.

6. The apparatus according to claim 5 wherein said foam pickup tube includes a discharge end for discharging foam through an opening in the cart, and the apparatus further includes a drain plug removably mounted in the discharge end of the pickup tube.

7. A portable fire fighting and vapor suppression apparatus comprising a substantially rectangular configured cart having a height, a top, a bottom, opposing front and rear sides, and two opposing sides to define a substantially rectangular configured enclosure, wherein said cart is a size so that it can be manually moved by a single individual, and including wheels mounted on the bottom to allow the cart to be wheeled about a location, said cart having an internal partition extending medially between the two opposing sides and along a substantial portion of the height of the cart adjacent the front side to form an enclosed storage area that extends along the front side of the cart and is separate from a remainder of the enclosure to form a holding tank for storing a foam concentrate, wherein said internal partition extends toward the rear side in an area adjacent the top of the cart to form an enlarged storage well, a foam eductor mounted within the enclosed storage area and extending along the front side and having an inlet positioned near the bottom of the cart for connecting to a source of water, said eductor including a foam mixing portion and a discharge, a foam pickup tube connected to the foam mixing portion of the eductor and extending through the internal partition to the holding tank for sucking the foam concentrate as the water is forced through the inlet and the eductor, and a fire hose having two ends, one of the ends connecting the eductor discharge and a nozzle connecting on another of the ends of the fire hose through which the water and foam discharged, wherein the fire hose is stored within the enlarged storage well, coiled in a double donut configuration so that as the fire hose is withdrawn, a corresponding length of the fire hose connected to the eductor is withdrawn.

8. The apparatus according to claim 7 further including a handle mounted on said top to facilitate manual rolling of said cart.

9. The apparatus according to claim 7 wherein said enlarged storage well includes an upper concave surface formed in the partition against which the stored fire hose is positioned.

10. The apparatus according to claim 7 further including a fill opening formed on the top through which the concentrate is poured into the holding tank.

11. The apparatus according to claim 7 wherein said foam pickup tube extends vertically downward from said partition to the bottom after entering the holding tank.

12. The apparatus according to claim 11 wherein said foam pickup tube includes a discharge end through which foam is discharged, and a drain plug removably mounted on the discharge end of the pickup tube.

* * * * *